US006076825A

United States Patent [19]

Kato et al.

[11] Patent Number: 6,076,825

[45] **Date of Patent: *Jun. 20, 2000**

[54] SHEET PROCESSING APPARATUS WITH MULTIPLE-POSITION STACKING TRAY

[75] Inventors: Katsuhito Kato, Toride; Kenichi Hayashi, Kashiwa, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/980,414

[22] Filed: Nov. 28, 1997

[30] Foreign Application Priority Data

Nov. 29, 1996 [JP] Japan ..... 8-320305

[51] Int. Cl.[7] ..... B65H 31/00

[52] U.S. Cl. ..... 271/207; 271/213; 271/210

[58] Field of Search ..... 270/292, 293, 270/294; 271/213, 210, 207

[56] References Cited

U.S. PATENT DOCUMENTS

| | | | |
|---|---|---|---|
| 4,925,171 | 5/1990 | Kramer et al. | 270/53 |
| 5,042,793 | 8/1991 | Miyake | 271/293 X |
| 5,186,454 | 2/1993 | Kitahara | 271/288 X |
| 5,350,169 | 9/1994 | Hiori et al. | 271/213 |
| 5,918,101 | 6/1999 | Kuroyanagi | 399/407 X |

*Primary Examiner*—Christopher P. Ellis
*Assistant Examiner*—Kenneth W Bower
*Attorney, Agent, or Firm*—Fitzpatrick, Cella, Harper & Scinto

[57] ABSTRACT

A sheet processing apparatus includes a stacking tray for accommodating sheets discharged thereto. A sheet discharging mechanism discharges the sheets to the stacking tray. A moving mechanism reciprocates moves substantially vertically the stacking tray between a first position, which is below the sheet discharging mechanism, and a second position between said first position and the sheet discharging mechanism. A controller controls the moving mechanism to move the stacking tray to the second position when the sheet discharged by said discharging means is discharged through a predetermined distance onto a stacking tray located at the first position.

14 Claims, 7 Drawing Sheets

SHEET PROCESSING APPARATUS WITH MULTIPLE-POSITION STACKING TRAY

FIELD OF THE INVENTION AND RELATED ART

The present invention relates to a sheet processing apparatus, more precisely, such a sheet processing apparatus that processes, for example, binds, the sheets sequentially discharged from an image forming apparatus, and then stores them.

In recent years, the number of fields in which image forming apparatuses are used has been rapidly increasing, and accordingly, the apparatuses have come to be expected to have more functions to meet specific needs in each field. For example, in order to handle a set of originals which contains a plurality of sheets which are different in size although they are in accordance with the same size standard (for example, A3 and A4, or B4 and B5), an image forming apparatus needs to be provided with a folding apparatus capable of properly folding both the large size sheet (A3, or B4) and the small size sheet (A4 or A5) in accordance with the sheet size.

Such a folding apparatus has been known, and one such folding apparatus is disclosed in the specifications to Japanese Laid-Open Patent Application No. 59002/1987 (official gazette). Thus, its detailed description will be not given here.

In spite of its advantages, the above described folding apparatus suffers from the following problems when used in combination with a sheet processing apparatus (sheet storing apparatus such as a sorter) based on the technology prior to the present invention.

Evidently, in order to improve the capacity for storing sheet sets, a sheet processing apparatus is expected to have as many bins as possible. However, increasing the number of bins in an apparatus of any given size requires the tray interval to be reduced, and as the tray interval is reduced, it becomes difficult to accommodate a large number of large sheets folded by the aforementioned folding apparatus.

Further, as a sheet is discharged into a tray in which folded sheets have been accumulated, the leading edge of the incoming sheet is liable to slip into the space created on the inward side of the crease of the topmost folded sheet as the folded sheet opens up due to the resiliency of the sheet at the fold. This is liable to cause a sheet jam.

In order to prevent the leading edge of the incoming sheet from entering the space on the inward side of the crease of the preceding folded sheet as the incoming sheet is discharged, a sufficient distance must be secured between the topmost sheet in the tray and a sheet discharging means by lowering the tray in which the preceding sheets have been deposited. However, this causes the following problem. Referring to FIG. 8 appended to this specification, securing a sufficient distance between the sheet discharging means and the topmost sheet in the tray is to increase the distance through which a sheet S, that is, the incoming sheet, free falls into a tray $B_{11}$ after it is discharged by a discharge roller pair 8*g*, and the increase in the free falling distance of the sheet S is liable to cause the sheet S to fail to properly settle in the tray $V_{11}$; for example, as the sheet S free falls by way of the position indicated by a chain line, the trailing portion of the sheet S may end up leaning on the top edge of the sheet stopper of the tray $V_{11}$, or the sheet S may entirely glide over the sheet stopper, failing to land in the tray $V_{11}$, in particular, when the topmost portion of the topmost sheet, that is, the folded sheet, in the tray $V_{11}$ curls upward enough to provide an air layer thick enough for the sheet S to glide on it as it slides back toward the sheet stopper.

SUMMARY OF THE INVENTION

An object of the present invention is to provide a sheet processing apparatus in which an incoming sheet is properly accumulated on the topmost sheet in a sheet accumulation tray even when the topmost sheet in the sheet accumulation tray is a folded sheet.

Thus, according to an aspect of the present invention, a sheet processing apparatus in accordance with the present invention, which was made in view of the above described problems, is characterized in that it comprises: a minimum of one sheet accumulation tray in which discharged sheets are accumulated; means for discharging sheets into said trays; means for moving said trays in the vertical direction; and means for controlling the vertical movement of said sheet accumulation tray between a first sheet reception point which is a predetermined distance below said sheet discharging means, and a second sheet reception point which is between the said sheet discharging means and the first sheet reception point.

More specifically, the sheet processing in accordance with the present invention is characterized in that it comprises: sheet accumulation trays for storing the sheets discharged from the sheet processing section; means for discharging the sheets into said accumulation trays; means for vertically moving said accumulation trays; and means for controlling said tray moving means in such a manner that when receiving a straight sheet, said accumulation tray is positioned at the default sheet reception point, which is a predetermined distance below said sheet discharging means, whereas when receiving a folded sheet, said sheet accumulation tray is initially positioned at the folded sheet reception point below the default point, and then, after a predetermined time, said accumulation tray is moved upward to the default point while the incoming sheet is still being discharged.

With the provision of the above construction, the sheet accumulation tray is shifted by the tray shifting means from the folded sheet reception point, that is, the lower sheet reception point, to the straight sheet reception point, that is, the upper sheet reception point, while the incoming sheet is still gripped by the sheet discharging means.

Further, when the topmost sheet in the sheet accumulation tray is a folded sheet, the leading edge of the incoming sheet does not hang up at the crease of the topmost sheet in the sheet accumulation tray, and in addition, the trailing portion of the incoming sheet is allowed to fall into the tray after the tray arrives at the straight sheet reception point, and therefore, the time necessary for the incoming sheet to settle in the tray decreases.

As is evident from the above description, according to the present invention, a sheet processing apparatus is structured so that the discharging of an incoming sheet is started after positioning a sheet accumulation tray at a sheet reception point at which the leading edge of the incoming sheet does not hang up on the topmost sheet in the sheet accumulation tray, and then, while the incoming sheet is being discharged, the tray is moved upward to another sheet reception point after the leading edge of the incoming sheet passes the critical point in the accumulation tray at which the incoming sheet is liable to hang up. Therefore, the time it takes for the incoming sheet to settle in the sheet accumulation tray becomes shorter, and also, inconvenient incidences such as the leading edge of the incoming sheet hanging up on the sheet in the sheet accumulation tray, and the trailing portion of the incoming sheet ending up leaning on the sheet stopper of the sheet accumulation tray, can be eliminated. As a result, sheets can be discharged into the sheet accumulation tray without incident.

Further, when the incoming sheet is a folded sheet, and the topmost sheet in the sheet accumulation tray is a straight sheet, the incoming sheet is discharged without moving the sheet accumulation tray downward from the straight sheet reception point to the folded sheet reception point; in other words, the incoming sheets can be continuously discharged while keeping the sheet accumulation tray adjacent to the sheet discharging means. Therefore, productivity improves in terms of the time consumed for sheet discharge.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment

Figure 1:
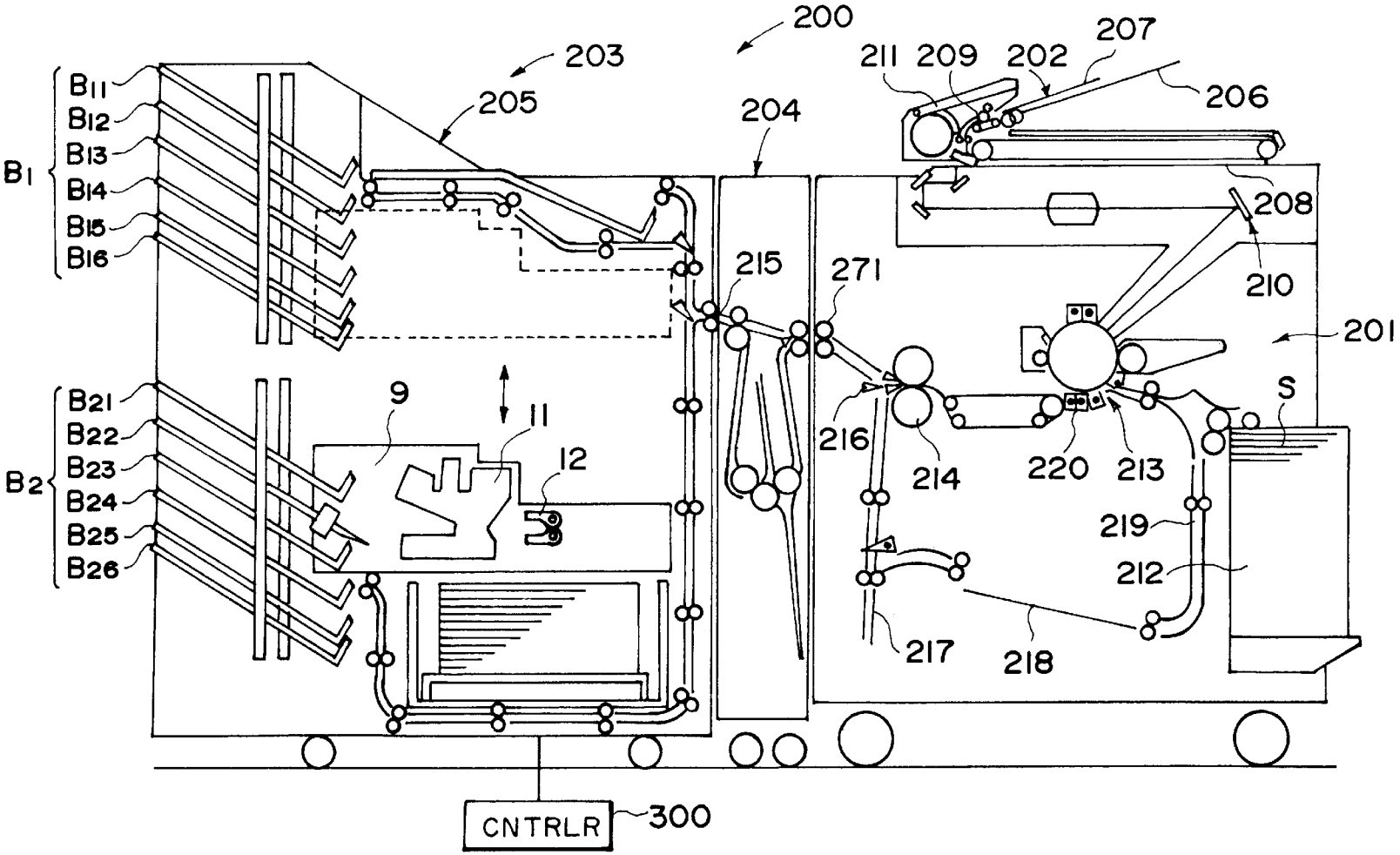
FIG. 1 is a vertical section of the sheet processing apparatus in the first embodiment of the present invention, and the main assembly of an image forming apparatus to which the sheet processing apparatus is connected, as seen from the front side of the apparatus.

Hereinafter, the embodiment of the present invention will be described with reference to the drawings. FIG. 1 illustrates an electrophotographic copying machine (image forming apparatus) 200 as an apparatus which outputs sheets.

The electrophotographic copying machine 200 is constituted of a main assembly 201, an automatic original feeder 202 positioned on top of the main assembly 201, and a sheet processing apparatus 203 positioned immediately next to the main assembly 201, on the side from which the sheets are discharged. The sheet processing apparatus 203 is constituted of a folding apparatus (folding means) 204, a stapler/stacker 205, and a controller 300 which controls each of the operational means.

A set of originals 207 placed on the original mounting table 206 of the automatic original feeder 202 is sequentially separated from the under side thereof, and fed into the main assembly 201 through a path 29, and is delivered onto a platen glass 208, where each original is read by an optical system 210 of the main assembly 201. After the reading, the original is further conveyed through a path 211, and then is discharged onto the topmost original on the original mounting table 206.

A sheet S is fed from a deck 212 into an image forming station 213, in which an image is formed on the sheet S. Then, the sheet S is sent to a fixing station 214. After image fixation in the fixing station 214, the sheet S is transferred from the main assembly 201 into a folder 204, in which the sheet S is selectively folded. Thereafter, the sheet S is conveyed to the sheet entrance 215 of a stapler/stacker 205.

Since the image forming process carried out in the copying machine 200 described above is well known, it will not be described here.

Figure 2:
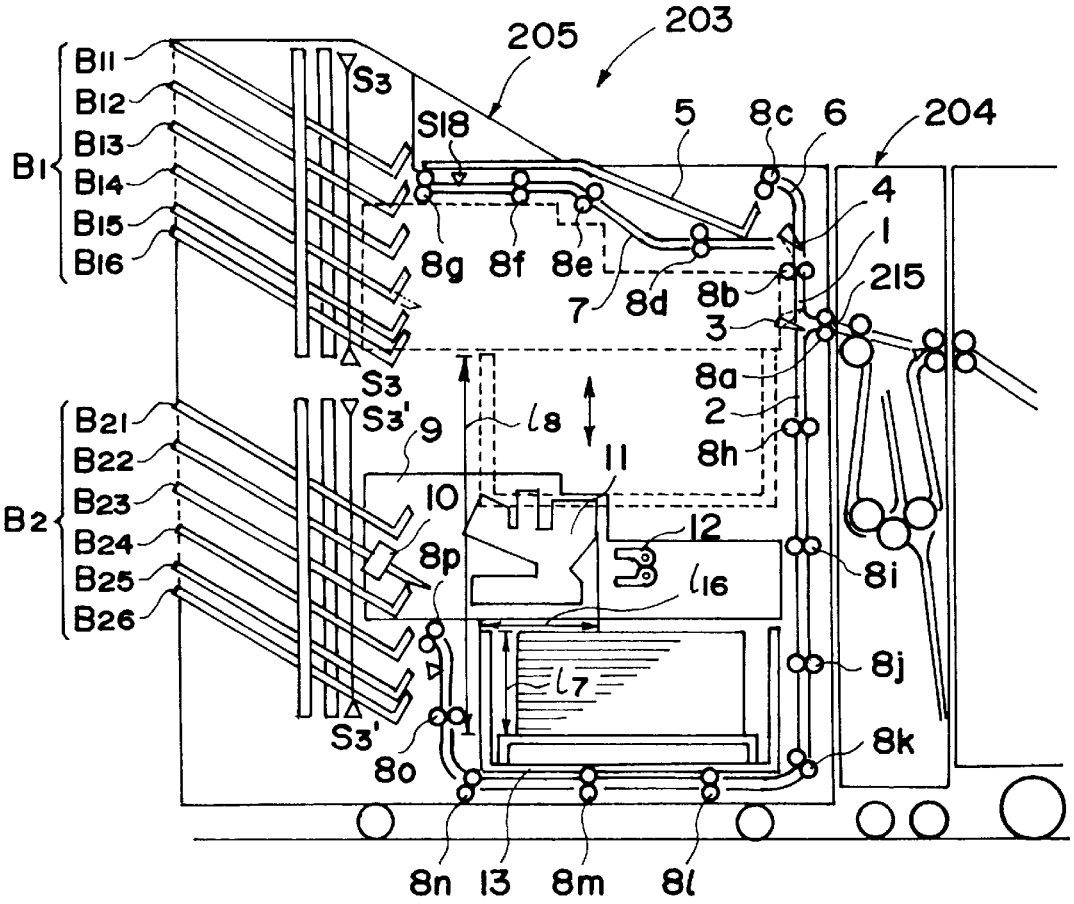
FIG. 2 is a vertical section of the sheet processing apparatus illustrated in FIG. 1, as seen from the front side.

Referring to FIGS. 1 and 2, the stapler/stacker 205 has bin modules $B_1$ and $B_2$, which are vertically stacked. Each bin module contains the same number of bins (sheet accumulating means); the top and bottom bins contain $B_{11}$–$B_{1n}$, and $B_{21}$–$B_{2n}$ (n=6 in the drawing). The bin interval and the bin position in each bin module can be varied by the rotation of a lead cam 16 so that each bin can be shifted to a sheet reception point or a sheet discharge point, independently from the other bin module.

The topmost bin ($B_{11}$, $B_{21}$) of each bin module $B_1$ or $B_2$ is enabled to move between the default sheet reception point, and another point which is at least one bin interval below the default sheet reception point. This arrangement will be described later in more detail.

At the sheet entrance 215, the direction in which the sheet S is advanced is set by a deflector 3 driven by an unillustrated solenoid SL3 to guide the sheet S upward into a first sheet conveyance path 1, or downward into a second sheet conveyance path 2. The first path 1 branches into a path 6 which leads to a non-sorting tray 5, and a path 7 which leads to a top bin module $B_1$. At the point at which the first path 1 branches into the two paths 6 and 7, a deflector 4, which is driven by an unillustrated solenoid SL4, is disposed.

On the other hand, the second path 2 leads directly into the bottom module $B_2$. In other words, when the sheet S is destined for the non sorting tray 5, the sheet S is conveyed by roller pairs 8*a*, 8*b*, and 8*c*; for the top module, by roller pairs 8*a*, 8*b*, and 8*d*–8*g*; and when destined for the bottom module, the sheet S is conveyed by the 8*a*, and 8*h*–8*p*. The roller pairs 8*g* and 8*p* constitute the roller pairs (sheet discharging means) which discharge the sheet S into the bins.

When the sheet S is destined for one of the bins in the top module $B_1$, the sheet S is discharged by the discharge roller pair 8*g* (sheet discharging means), and when the sheet S is destined for one of the bins in the bottom module $B_2$, the sheet S is discharged by the roller pair 8*p* (sheet discharging means).

The stapler/stacker 205 is provided with a gripper/stapler unit 9, which is located in the space surrounded by the sheet path 1 to the top module $B_1$, and the sheet path 2 to the bottom module $B_2$. In the gripper/stapler unit 9, a set of sheets is advanced a predetermined distance by a gripper 10, in the rightward direction in FIGS. 1 or 2, and is selectively stapled by a stapler 11. Thereafter, the stapled set of sheets is conveyed further rightward by a gripper 12, which grips the leading edge of the stapled set of sheets.

Then, the stapled set of sheets conveyed by the gripper 12 is deposited into a stacker unit 13, which is waiting below the gripper/stapler unit 9 in the aforementioned space surrounded by the path 1 to the top module $B_1$ and the path 2 to the bottom module $B_2$. The stapled set of sheets deposited in the stacker unit 13 is stored therein.

Referring to FIG. 2, the right-hand portion of the stapler 11 and the left-hand portion of the stacker unit 13 vertically overlap by a length of $L_{15}$.

After the bins $B_{11}$–$B_{16}$ of the top module $B_1$ are filled with sheet sets, the gripper/stapler unit 9 is moved to the location outlined by a broken line in FIGS. 1 and 2 to take out the processed sheet sets from the bins. Even while the sheet sets are removed from the bins of the top module $B_1$, the following sheets are delivered into the bins $B_{21}$–$B_{26}$ of the bottom module $B_2$. Then, after the removal of the sheet sets from the bins $B_{11}$–$B_{16}$ of the top module $B_1$, and the delivery of the sheet sets into the bins $B_{21}$–$B_{26}$, are completed, the gripper/stapler unit 9 is lowered to the location outlined by a solid line in FIGS. 1 and 2 to remove the sheet sets from the bottom module $B_2$. This operation can be continuously repeated until the stacker unit 13 becomes full; the image forming operation can be carried out without interruption until the stacker unit 13 becomes full.

After being discharged from the main assembly 201, the sheets S are selectively folded into the shape of a letter C or Z, and then are conveyed to the bin modules $B_1$ or $B_2$.

Next, the bin modules $B_1$ and $B_2$ will be described.

Figure 3:
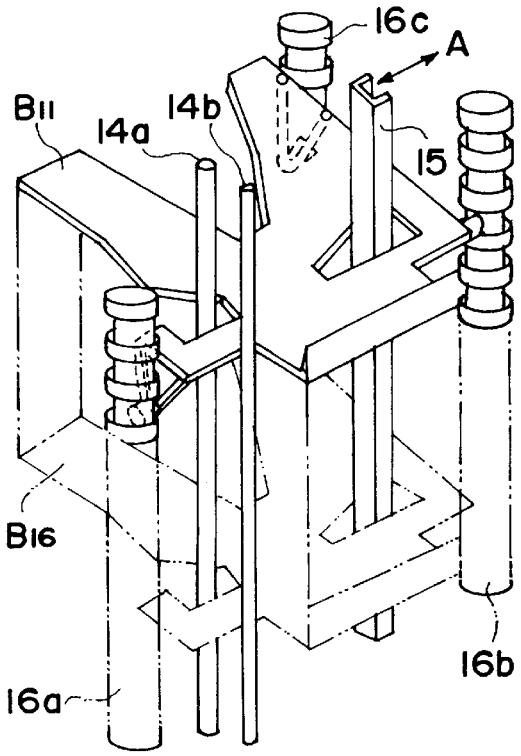
FIG. 3 is a perspective view of the bin module in the sheet processing apparatus illustrated in FIG. 2.

FIG. 3 is a perspective view of the bin module. The following description of the bin module is given with reference to the top bin module $B_1$. The structure of the bottom bin module $B_2$ is substantially the same as that of the top bin module $B_1$.

The bin module $B_1$ essentially comprises the plurality of bins $B_{11}$–$B_{1n}$, two referential rods 14*a* and 14*b*, an aligning wall 15, lead cams 16*a*–16*c* which vertically move the bins and a means for driving the preceding components. The referential rods 14*a* and 14*b* are the members which provide a referential line when the sheets S discharged into any given bin are processed, for example, stapled. Normally, they are kept slightly away from the edge of the bin where they are positioned at the time of sheet discharge. The aligning wall 15 pushes the sheets discharged into the bin, one at a time, or two or more at a time, in the direction (direction indicated by an arrow mark A) perpendicular to the direction in which the sheets have been conveyed. As a result, the sheets become aligned against the referential rods 14*a* and 14*b* as the sheet edges opposite to the side in contact with the aligning wall 15 are bumped against the referential rods 14*a* and 14*b*.

Figure 4:
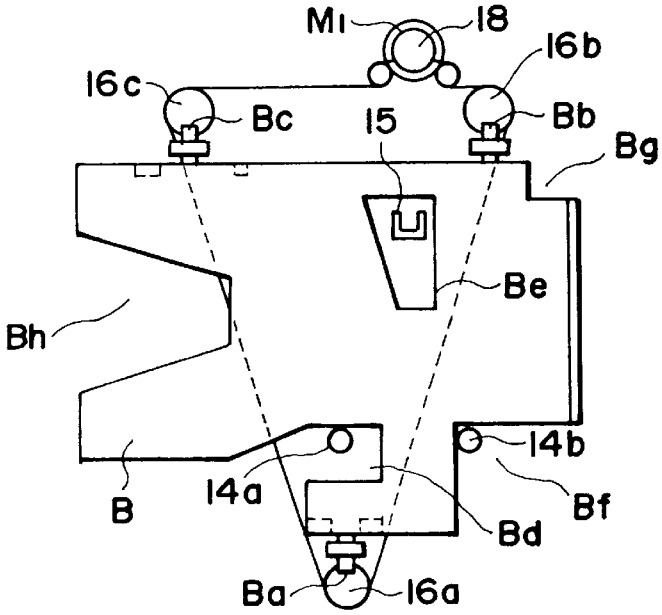
FIG. 4 is a top view of the bin module illustrated in FIG. 3.

FIG. 4 is a top view of the bin module. The lead cams 16*a*, 16*b* and 16*c* are spiral cams. As for their positioning, one is located on the front side, and the other two are located at the rear as illustrated in FIGS. 3 and 4. In the grooves of the lead cams, the rollers Ba, Ba and Bc attached to the bin in a manner to horizontally protrude from the edge of the bin are correspondingly fitted, and each time these lead cams synchronously rotate, the bin is moved upward or downward a predetermined distance, that is, a distance equal to the cam pitch.

Also referring to FIG. 4, each bin is provided with a notch Bd which accommodates the referential rod 14*a*, a hole Be which accommodates the aligning wall 15, as well as a notch Bf for the conveyance gripper 12, a notch Bg for a mechanism which drives the sheet stopper, and a notch Bh which is operationally necessary.

Next, it will be described how the bins are shifted (FIG. 4).

The driving force from a bin shift motor M1 is synchronously transmitted to the lead cam 16*a*–16*c*, through a motor pulley 18, a belt 19, and lead cam pulleys 20*a*–20*c*, to rotate the lead cams 16*a*–16*c* in synchronism. With each turn, the lead cams are rotated forward or backward, the bin is moved up or down by a distance equal to the cam pitch. The bin shift motor M1 is provided with an encoder (unillustrated), which is located on the side opposite to the pulley 18, and detects the rotational angle of the bin shift motor M1 through an unillustrated sensor.

The shift motor M1, and the lead cams 16*a*–16*c*, and the rest, which were described above, constitute a means for vertically moving the bin.

Further, the bin modules $B_1$ and $B_2$ are each provided with a home position detection sensor S2 (unillustrated), which detects whether or not the top most bin $B_{11}$ or $B_{21}$ is at its sheet reception point H. Also, above the bin modules $B_1$ and $B_2$, sensors S3 and S3' are positioned, respectively, (FIG. 2) to detect the presence of the sheet in any of the bins, so that the decision regarding the timing for switching the modules, or the like, can be properly made.

Next, a folding/sorting mode will be described.

In the folding/sorting mode, a sheet of a large size is folded into a desired small size with the use of the folding apparatus 204 illustrated in FIG. 2, and then is discharged into the bin by the discharge roller pairs 8*g* or 8*p*, through the same path as a sheet which is not folded.

The only difference in this folding/sorting mode is that the bin into which the sheets are discharged is limited to the topmost bins $B_{11}$ and $B_{21}$ of the bin modules $B_1$ and $B_2$, respectively.

Figure 7:
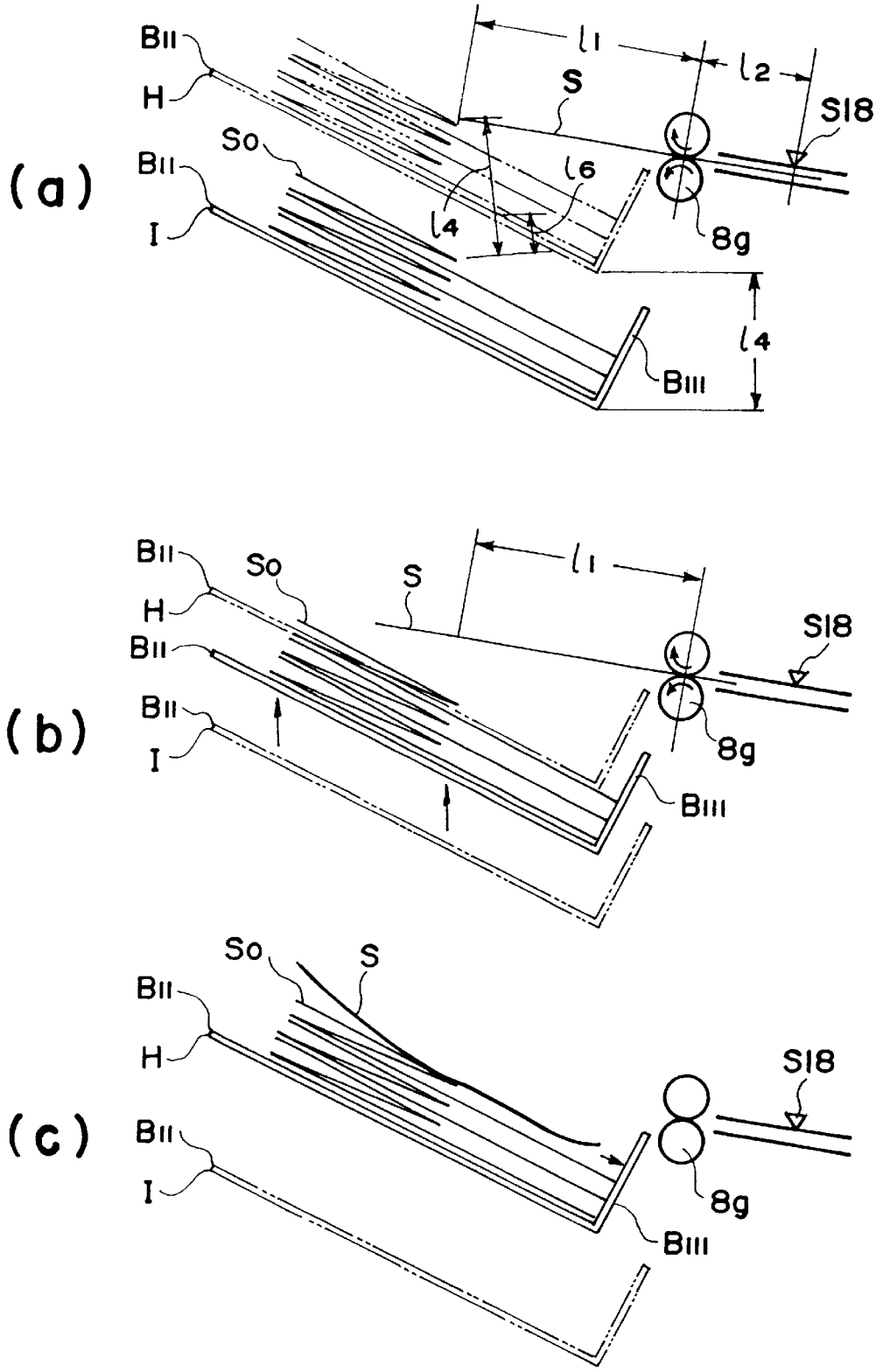
FIG. 7 is a cross section of the sheet accumulation tray and its adjacencies, and depicts the movement of the sheet accumulation tray at the time of the sheet discharge into the sheet accumulation tray in the sheet processing apparatus illustrated in FIG. 2.
Figure 8:
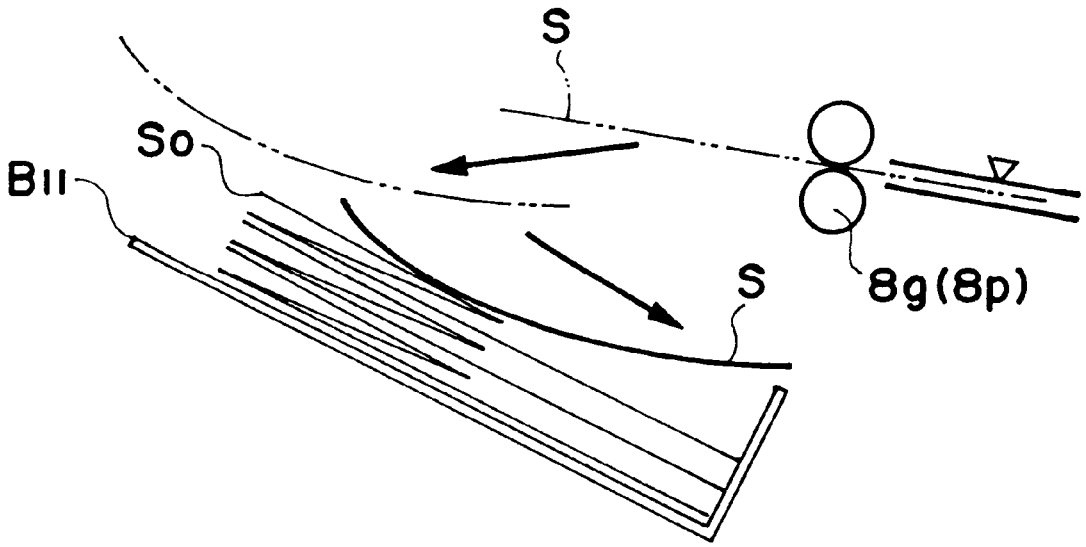
FIG. 8 is a vertical section of the sheet discharging portion of a sheet processing apparatus based on the art prior to the present invention, as seen from the lateral side of the sheet accumulation tray.

The topmost bins $B_{11}$ and $B_{21}$ are enabled to freely move between the default sheet reception point H where a straight sheet is received, and another sheet reception point I (point where a folded sheet is received) which is below the default sheet reception point H, by a distance equivalent to a single bin interval. When a folded sheet is received, the topmost bins $B_{11}$ and $B_{21}$ are set at the folded sheet reception point I (FIG. 7).

More specifically, as the topmost bin is lowered any given number of bin intervals, the space above the topmost bin becomes large enough to accommodate a bulky sheet Such as a folded sheet, and therefore, a plurality of sheets can be accumulated without incident even though the apparatus is in the folding/sorting mode.

Also in the folding/sorting mode, the distance the topmost bin $B_{11}$ or $B_{21}$ is moved to the lower sheet reception point I is preset so that an imaginary line extended from the discharge roller pair 8*g* or 8*p* in the direction of sheet discharge, in parallel with the direction of sheet discharge, comes above the folded portion of the topmost sheet in the topmost bins $B_{11}$ or $B_{21}$, respectively.

With this arrangement, even if the folded portion of a preceding sheet folded by the folding apparatus 204 slightly rises due to the resiliency of the sheet, the leading edge of a sheet discharged next remains above the folded portion of the preceding sheet as it is discharged. Therefore, a sheet jam does not occur.

Figure 5:
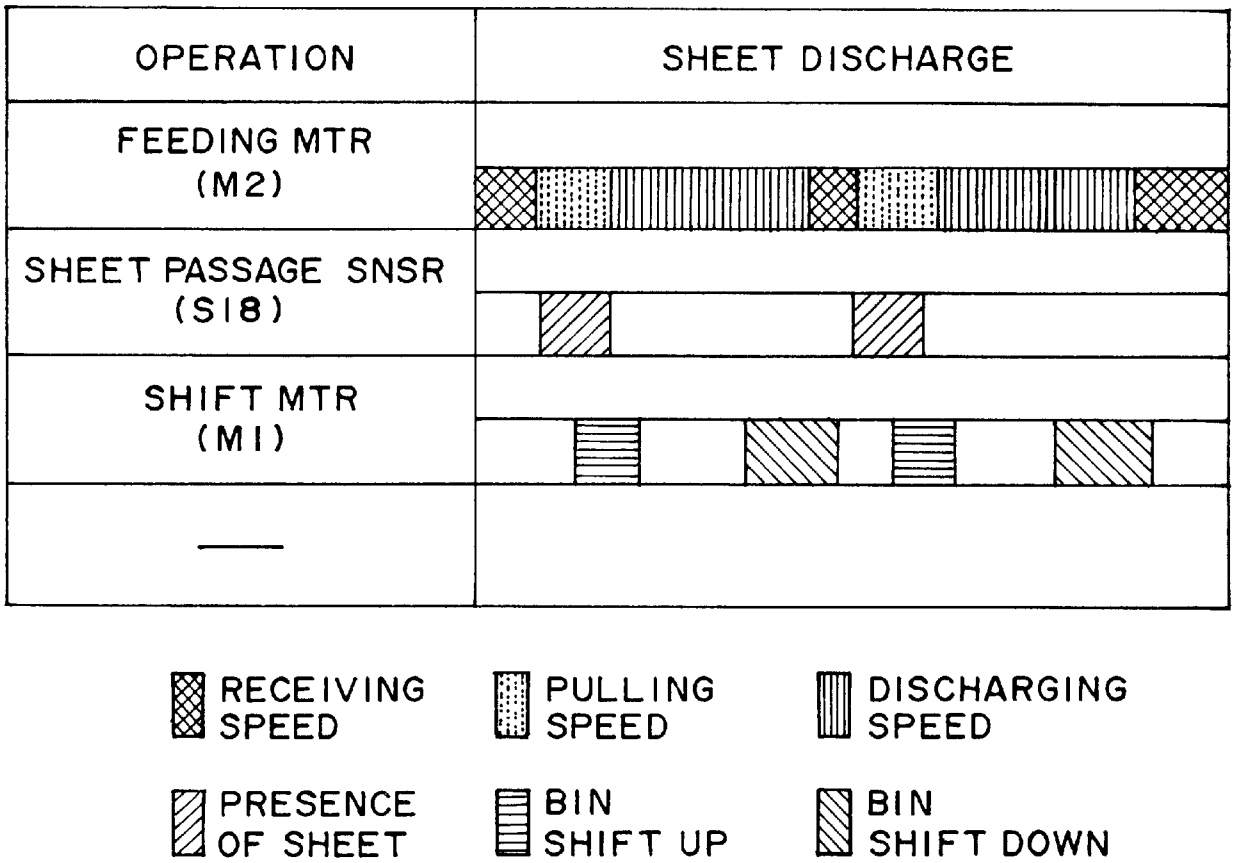
FIG. 5 is a timing chart for the operation of the sheet processing apparatus illustrated in FIG. 2.

Next, referring to FIGS. 5 and 6, the sheet discharging operation in this embodiment will be described.

Figure 6:
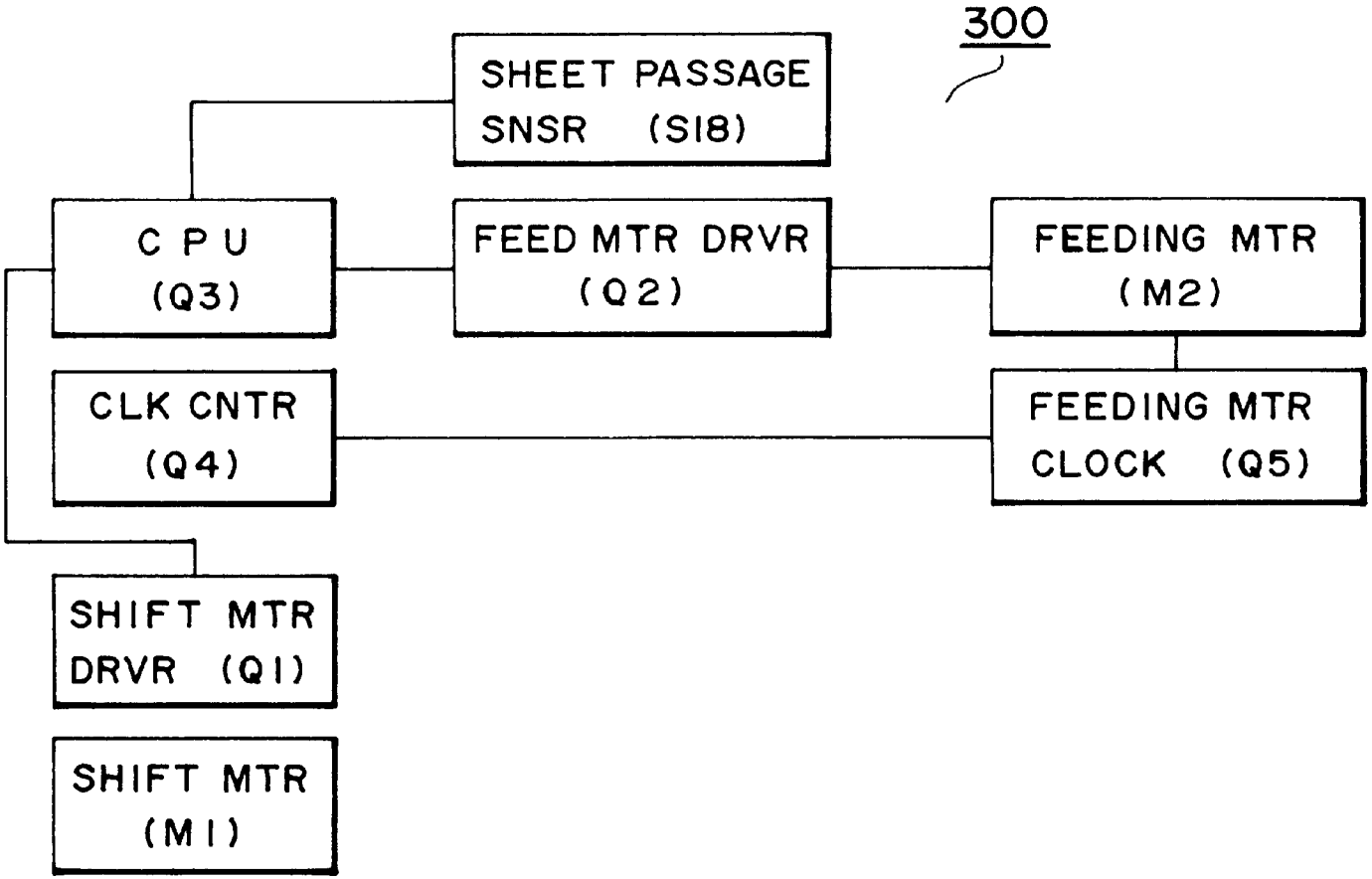
FIG. 6 is a block diagram which depicts the control of the sheet processing apparatus illustrated in FIG. 2.

FIG. 6 is a block diagram regarding the sheet discharge and bin shift in this embodiment. A conveyer motor M2 is connected to a CPU Q3 through a conveyer motor driver Q2, and rotates an optional number of times in response to the signal from the CPU Q3, to convey sheets.

Further, the conveyer motor M2 is connected to a conveyer motor clock Q5 which is connected to the CPU Q3 through a clock counter Q4. In this embodiment, a single rotation of the conveyer motor M2 sends out 60 clock pulses. On the upstream side of the discharge roller pair 8*g*, in terms of the sheet conveyance direction, a sheet passage sensor S18 is located, a distance of $1_2$ away from the discharge roller pair 8*g*, and is also connected to the CPU Q3 (FIG. 7).

The shift motor M1 is connected to the CPU Q3 through the shift motor driver Q1, and rotates forward or backward an optional number of times in response to the signal from the CPU Q3, to shift the bin module upward or downward.

With the provision of the above arrangement, the speed of the conveyer motor M2 can be changed after a sheet detected by the sheet passage sensor S18 is conveyed farther from the sensor S18 for a duration equivalent to an optional number of clock pulses, and also the bin module can be shifted upward or downward with the same timing as the timing for the speed change for the conveyer motor. FIG. 5 is a timing chart for the sheet discharging operation in this embodiment.

At first, the conveyer motor M2 is rotated at the speed for receiving a sheet from the image forming apparatus 201. As the leading edge of a sheet activates the sheet passage sensor 18, the speed of the conveyer motor M2 is increased to increase the speed at which the sheet is pulled in, so that sheet interval between the sheet being received and the following sheet is increased. Then, as the trailing edge of the sheet deactivates the sheet passage sensor S18, the speed of the conveyer motor M2 is reduced to the speed for discharging the sheet into the bin, and the sheet is discharged at this speed. Before the sheet is discharged into the bin, the bin is lowered from the point H to the point I by inputting a folding mode signal.

Meanwhile, the rotation of the shift motor M1 is started after the conveyer motor M2 rotates a certain number of times equivalent to a predetermined number N of clock pulses after the leading edge of the sheet activates the sheet passage sensor 18, shifting thereby the bin upward from the point I (first sheet accumulation point, or the folded sheet reception point) to the point H (second sheet accumulation point, or the default position). The time for this upward shifting of the bin is set to be shorter than the time necessary for the trailing edge of the sheet to come in contact with the sheet stopper $B_{111}$, of the bin. The distance between the points I and H in this embodiment is equivalent to two bin intervals.

The value of the aforementioned number N of the pulse is set in accordance to the following formula:

$$1_1+1_2 \leqq 1_3 \times N$$

wherein $\mathbf{1}_1$ is the distance from the nip of the discharge roller pair 8*g* to the crease of the folded sheet; $\mathbf{1}_2$, the distance from the nip of the discharger roller pair 8*g* to the sensor S18; and $\mathbf{1}_3$ is the distance a sheet is conveyed per single pulse supplied to the conveyer motor M2.

Thus, the bin $B_{11}$ begins to move upward after the leading edge of the incoming sheet passes the crease of the topmost folded sheet in the bin $B_{11}$, and while the bin $B_{11}$ is moving to the sheet reception point H, the trailing portion of the incoming sheet continues to be discharged into the bin 11, and is completely discharged into the bin $B_{11}$ slightly after the bin $B_{11}$ arrives at the sheet reception point H. This can be accomplished by controlling the speed at which the bin $B_{11}$ is moved upward. Then, the trailing edge of the completely discharged incoming sheet comes in contact with the sheet stopper $B_{111}$, and the sheet settles down on top of the preceding sheet in the bin $B_{11}$. Then, after a predetermined time set for allowing the just discharged sheet to settle, and before the leading edge of the following sheet activates the sheet passage sensor 18, the shift motor M1 is rotated in reverse to move the bin $B_{11}$ from the point H to the point I.

With the repetition of the above-described operational sequence, sheets can be sequentially accumulated in the bin $B_{11}$ without incident.

The value of N may be set in accordance with a formula: $1_1+1_2>1_3 \times N$, in other words, the upward movement of the bin $B_{11}$ may be started before the leading edge of the incoming sheet reaches the crease of the topmost folded sheet in the bin $B_{11}$. Even in this case, the leading edge of the incoming sheet does not hang up at the crease of the preceding sheet as long as a distance 16 between the point I, and the point at which the upward moving bin $B_{11}$ is when the leading edge of the incoming sheet arrives at the crease of the preceding sheet in the bin $B_{11}$, is smaller than a distance $\mathbf{1}_4$ between the points I and H, that is, the distance the bin $B_1$ vertically travels in the folding/sorting mode. When the bin $B_{11}$ is shifted upward with this timing, the sheet interval can be reduced, and therefore, productivity increases.

When the sheet processing apparatus is in a mode in which folded sheets and straight sheets are accumulated in a mixture, as long as the topmost sheet in the bin $B_{11}$ is a straight sheet, the leading edge of the incoming sheet does not hang up even if the bin $B_{11}$ is at the point H. Therefore, a sheet conveyed immediately after the straight sheet may be discharged at the point H, in other words, without shifting the bin $B_{11}$ downward from the point H to the point I.

While the invention has been described with reference to the structures disclosed herein, it is not confined to the details set forth and this application is intended to cover such modifications or changes as may come within the purposes of the improvements or the scope of the following claims.

What is claimed is:

1. A sheet processing apparatus comprising:

a stacking tray for stacking sheets discharged thereto;

sheet discharging means for discharging the sheets to said stacking tray;

moving means for reciprocally moving substantially vertically said stacking tray between a first position, which is below said sheet discharging means and a second position between said first position and said sheet discharging means; and control means for controlling said moving means to move said stacking tray to the second position when the sheet discharged by said discharging means is discharged through a predetermined distance onto said stacking tray located at the first position.

2. An apparatus according to claim 1, further comprising sheet detecting means, disposed upstream of said sheet discharging means, for detecting the sheet, wherein said sheet discharging means reduces a sheet discharging speed when said sheet detecting means detects a leading edge of the sheet, and increases the sheet discharging speed when said sheet detecting means detects a trailing edge of the sheet.

3. An apparatus according to claim 1, wherein said stacking means starts to move from the first position to the second position after a leading edge of a subsequent sheet moves beyond a position on the sheet already stacked on said stacking tray where the subsequent sheet contacts the sheet already stacked on said stacking tray.

4. An apparatus according to claim 1, wherein said stacking means starts to move from the first position to the second stacking at such timing that a leading edge of a subsequent sheet moves beyond a position on the sheet already stacked on said stacking tray without contacting the already stacked sheet at the position.

5. An image forming apparatus comprising:

a sheet processing apparatus as defined in any one of claim 1;

an image forming station for forming an image on a sheet, which is fed to said sheet processing means.

6. An apparatus according to claim 1, wherein a sheet folding means for folding the sheet is provided upstream of said sheet discharging means.

7. An apparatus according to claim 6, wherein said control means controls said stacking tray to stack a folded sheet, which has been folded by said folding means, on said stack located at the first position and to move said stacking tray to the second position, when a nonfolded sheet is discharged through the predetermined distance by the sheet discharging means immediately after the folded sheet is discharged thereby.

8. An apparatus according to claim 6, wherein said control means controls said moving means such that while the folded sheet is gripped by said discharging means, said stacking tray is moved to the second position.

9. An apparatus according to claim 8, further comprising a sheet detecting means disposed upstream of said sheet discharging means, and wherein said stacking tray is moved from the first position to the second position a predetermined time after said detecting means detects passage of a leading edge of the folded sheet.

10. An apparatus according to claim 1, wherein said control means controls said moving means to move said stacking tray to the second position and then to move said stacking tray to the first position before discharge of a next sheet.

11. An apparatus according to claim 10, wherein said apparatus is operable in a mixed stacking mode in which a mixture of folded sheets and nonfolded sheets is stacked, wherein when at least two nonfolded sheets are continuously discharged after the folded sheets, and wherein said control means does not move said stacking tray after a first one of the two nonfolded sheets and maintains said stacking tray at the second position to accommodate the nonfolded sheets sheet.

12. A sheet processing apparatus comprising:

a sheet folder for selectively folding sheets;

a stacking tray for accommodating sheets discharged thereto;

sheet discharging means for discharging sheets to said stacking tray;

moving means for moving substantially vertically said stacking tray; and control means for controlling said moving means to maintain said stacking tray at a standard position which is lower than an outlet of said sheet discharging means when the nonfolded sheet is received, to maintain said stacking tray at a sheet fold position, which is lower than the standard position when the folded sheet is received, and then to move said stacking tray to the standard position during discharging of the folded sheet.

13. An apparatus according to claim 12, wherein said stacking trays are topmost ones of said stacking trays, which are overlapped in the vertical direction and are sequentially opposed to said sheet discharging means by said moving means.

14. An apparatus according to claim 13, wherein a distance between said standard position and said sheet fold position corresponds to an interval between said trays.

* * * * *

UNITED STATES PATENT AND TRADEMARK OFFICE

CERTIFICATE OF CORRECTION

PATENT NO. : 6,076,825
DATED : March 20, 2000
INVENTOR(S) : Katsuhito Kato, et al.

It is certified that error appears in the above-identified patent and that said Letters Patent is hereby corrected as shown below:

Title Page,
Item [57] ABSTRACT:
Line 4, "reciprocates moves" should read --reciprocally moves--.

Column 2:
Line 61, "incidences" should read --incidents--.

Column 4:
Line 30, "non-sorting" should read --nonsorting--.
Line 26, "non-sorting" should read --nonsorting--.

Column 6:
Line 34, "Such" should read --such--.

Column 7:
Line 44, "$1_1$" should read --$\ell_1$--.
Line 45, "$1_2$" should read --$\ell 2$--.
Line 47, "$1_3$" should read --$\ell_3$--.
Line 53, "11," should read --$B_{11}$,--.

UNITED STATES PATENT AND TRADEMARK OFFICE

CERTIFICATE OF CORRECTION

PATENT NO. : 6,076,825
DATED : March 20, 2000
INVENTOR(S) : Katsuhito Kato, et al.

It is certified that error appears in the above-identified patent and that said Letters Patent is hereby corrected as shown below:

Column 8:
Line 7, "16" should read --$\ell_6$--.
Line 11, "$1_4$" should read --$\ell 4$--.
Line 60, "stacking" should read --position--.
Line 66, "claim 1;" should read --claims 1, 2, 3, 4, 6, 8, 9, 10, 11, 12, 13, or 14--.

Column 10:
Line 3, "sheets" should read --sheets.--
Line 4, "sheet." should be deleted.

Signed and Sealed this

Twenty-sixth Day of June, 2001

Nicholas P. Godici

*Attest:*

*Attesting Officer*

NICHOLAS P. GODICI
*Acting Director of the United States Patent and Trademark Office*